United States Patent [19]

Phillips

[11] 4,382,547

[45] * May 10, 1983

[54] RAILROAD TIE PLATE AND CORRECTABLE SHIM

[76] Inventor: Albert A. Phillips, Rte. 1, Box 56A, Byars, Okla. 74831

[ * ] Notice: The portion of the term of this patent subsequent to Apr. 7, 1998, has been disclaimed.

[21] Appl. No.: 245,203

[22] Filed: Mar. 18, 1981

Related U.S. Application Data

[63] Continuation-in-part of Ser. No. 127,995, Mar. 4, 1980, Pat. No. 4,260,105.

[51] Int. Cl.[3] ..... E01B 9/44; E01B 9/10

[52] U.S. Cl. ..... 238/303; 238/281; 238/287; 238/304; 238/306; 238/340; 238/372

[58] Field of Search ..... 238/264, 281, 283, 287, 238/303, 304, 306–308, 310, 338, 340, 342, 372, 373

[56] References Cited

U.S. PATENT DOCUMENTS

| | | | |
|---|---|---|---|
| 954,538 | 4/1910 | McKee | 238/303 |
| 956,499 | 4/1910 | McKee | 238/303 |
| 979,478 | 12/1910 | Hall | 238/303 X |
| 1,001,879 | 8/1911 | Moorhead et al. | 238/304 X |
| 1,083,270 | 1/1914 | Braine | 238/372 X |
| 2,008,946 | 7/1935 | Cooper | 238/304 |
| 2,354,506 | 7/1944 | Doke | 238/340 X |
| 3,469,784 | 9/1969 | Campbell et al. | 238/287 |
| 4,260,105 | 4/1981 | Phillips | 238/287 X |

*Primary Examiner*—Randolph Reese
*Attorney, Agent, or Firm*—Browdy and Neimark

[57] ABSTRACT

A railroad plate and connectable shim are disclosed for fastening railroad tracks over ground having a flat or raised topography in an economically feasible manner. The instant system provides a base plate with a sloping grooved channel for reception of the lower flange of a rail to be held in place in combination with a trapezoidal shim to insure the proper cant of the rail over the various topographical areas of the country. The instant base plate, trapezoidal shim, rail and railroad tie are all fastened via a set of screws which are angled or toed-in towards the center of gravity of the rail. Stepped washers, each possessing a thickened portion, are provided between the bottom of the screw head and the upper shoulder surface of the lower flanges, both inside and outside the central vertical portion of the rail. The washers are omitted in securing back assemblies to the ties where joints are formed between the ends of adjacent rails. When a train wheel engages the crown portion of a straight or flat trackway, where trapezoidal shims are not used, the rail angulates vertically about 3°. On curved trackways however, the trapezoidal shims are included in the rail assembly and the total vertical inclination of the rail is 6°. Thus the train load is substantially balanced between the opposing track rails which prevents shelling and uneven wear of the train wheels and the crown surfaces of the rails contributing to increased longevity for both rails and wheels.

6 Claims, 9 Drawing Figures

FIG. 6
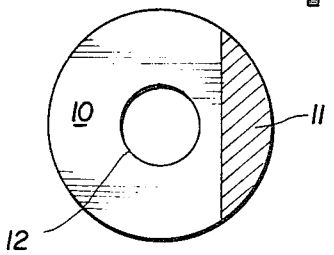
FIG. 7
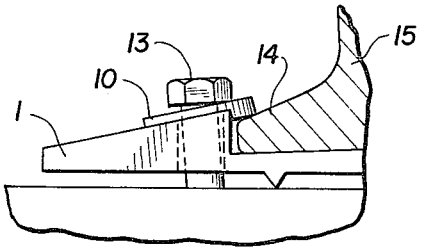
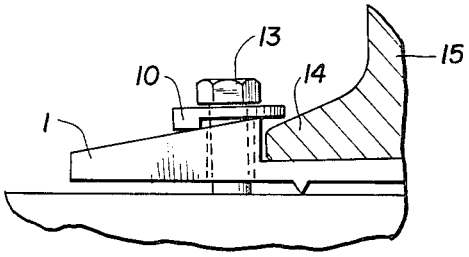
FIG. 8
FIG. 9
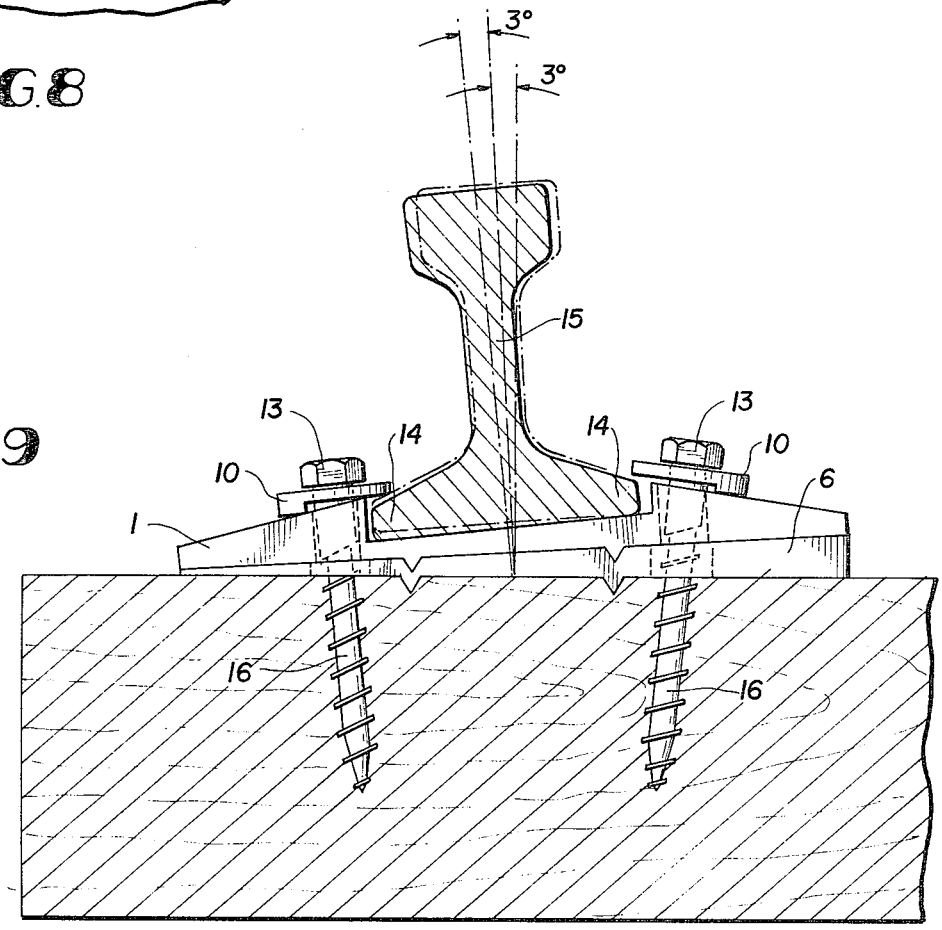

RAILROAD TIE PLATE AND CORRECTABLE SHIM

CROSS-REFERENCE TO RELATED APPLICATIONS

This application is a continuation-in-part of my copending parent application Ser. No. 127,995 filed Mar. 4, 1980, now U.S. Pat. No. 4,260,105 the contents of which are hereby incorporated by reference.

FIELD OF THE INVENTION

The present invention relates to improvements in transportation, and more particularly to improved railroad track beds.

BACKGROUND OF INVENTION

As a consequence of the high escalating cost of diesel fuel, the railroad industry has found it necessary to pull heavier and longer loads of rolling stock over its rail systems. These systems in most states have become somewhat deteriorated from lack of proper maintenance and sometimes are passable only at greatly reduced speed. Recently questions into the safety of transporting hazardous materials by rail have been raised as a result of the seemingly many accidents caused by these antiquated rail systems and the magnitude of a potential disaster when a hazardous cargo spills during its passage through highly populated areas.

Rail fastening devices have been available to the train industry almost from the time of its inception. One such rail-fastening system is set forth in U.S. Pat. No. 874,535, Dec. 24, 1907, issued to Percival. In this system a rectangular cushion is fitted to tightly engage the rail and provide a recess in which the bottom portions of the lugs or spikes engage the rail to hold the same firmly in position. This cushion prevents the lug heads on the outside from leaving the flanges of the rail during heavy use. The material of the cushion is taught as being elastic in nature, such as wood.

A second U.S. Pat. No. 914,093, issued to Weston in 1909, discloses a tie plate system to prevent the "creeping" of the rail over the plate and substructure. Succinctly stated, this is accomplished by use of a tie plate with oppositely disposed shoulder formations adapted to grip the edges of the rail base when the rail is seated. Another 1909 U.S. Pat. No. 935,679, issued to McWethy, discloses a rail tie of concrete having adjustable rail chairs to confirm to the grade of the road bed. These rail chairs have a seat or chair cut out for the base flange of the rail. The yokes holding the rail chairs to the ties are adjustable to conform to the extent of torque exerted on the rail chairs in relation to the gage of the road. In U.S. Pat. Nos. 956,499 and 954,538, both issued to McKee, a rail is held in place by spikes situated on an incline and passing through a tie plate to allow the rail to have a fixed quantum of play. Other similar rail fastening assemblies are shown in U.S. Pat. Nos. 1,001,879 and 2,008,946.

A railroad tie block is disclosed in U.S. Pat. No. 1,076,577, issued to Hollis, which comprises a grooved wooden block channelled for reception of the bottom portion the rail to be held. The flanges of the screws provide a means to secure the rail and also provide easy repair or removal of the tie block portion. In U.S. Pat. No. 1,443,275, issued to Radelet in 1922, a system is disclosed for the fastening of a rail to a tie member. A bearing plate is provided to receive the conical head of a holding screw and thereby firmly secure the bottom flange of a rail pressed beneath the bearing plate. An angular holding clip is disclosed in Wesolik, U.S. Pat. No. 1,454,090 (1922) for securing the bottom flange of a rail. The latter is inserted in the angularly raised portion of the clip and likewise the tie transversing the underneath side of the clip. A 1935 patent to Boyce, U.S. Pat. No. 2,018,658, disclosed a tie plate having a recessed area for the seating of the bottom flange of a rail and underneath extending ribs for securing the tie plate to a wooden railroad tie.

A system utilizing a holding or fastening clip is disclosed in U.S. Pat. No. 3,004,715 (1961). A special securing bolt having both horizontal and vertical serrations is provided to insure the bonding of the bolt to the railroad tie. The disclosed tie plate has a grooved portion for the reception of the bottom flange of the rail. A pad of rectangular configuration is available if desired to be situated between the tie plate and tie. This pad may be made of fiber or insulated material and can be used in signal track section where insulating qualities are important. An insulating and cushioning pad is disclosed in U.S. Pat. No. 3,268,170 (1966) which is mounted on a cross tie and supported on a concrete bed. The rail is held in place via a steel bearing plate having the resilent pad thereunder completely encompassing and thereby insulating the rail to be traversed by a subway train.

A patent issued to Campbell et al., U.S. Pat. No. 3,469,784 (1969), discloses that the prior art generally desired to contour the rails to the conical shape of the wheel slope. The problem of "shelling" the outer rail in a curved track was addressed by increasing the outer-curve rail to a 2 in 40 slope to thereby distribute the wheel load over a much greater top area of the rail. This increase in the cant is accomplished by a tapered insert which is anchored by spikes also passing through the rail plate and passing in a perpendicular manner into the rail tie. Another recent U.S. Pat. No. 4,141,500 (1979), issued to Gragnani, discloses a railway tie plate having at least one rib to locate the rail and two arches under which parts of rail chips are driven parallel to the rib.

The aforementioned prior art generally discloses problems and solutions to various problems concerning the longevity of a track system. The instant prior art does not show or suggest a system as herein disclosed and set forth in the appended claims.

SUMMARY OF INVENTION

The instant invention, which is an improvement over the embodiment disclosed in my above referred to parent application Ser. No. 127,995, provides a system whereby the railroad industry can easily and feasibly install and repair their rail systems with respect to both straight and curved track, and this is accomplished in an economical manner to provide a safer track bed.

It has been determined that a cant of approximately 3° is preferred for the placement or replacement of straight rails, and a greater cant is needed around curves. Until now, there has not been a convenient system for combining an uneven channelled base plate with an uneven shim to provide for easy repair of the rails possessing a predetermined cant, and provide a cushioned or "floating" rail. This invention meets that need and also provides a system to secure the rail in a much more economically feasible manner.

The instant disclosed system also provides a more economical means to attach the bottom flange of a rail to a base plate and railroad tie by means of eliminating one fastening means from the outside of the rail base plate. Thus, this invention provides an article of manufacture to enable the railroads to repair or situate new tracks into proper position in an economical manner to prevent "shelling" of the rails as a result of passage of the conical shaped steel wheels of the railroad.

This invention relates to an improvement in the use of canted railroad base plates in combination with a trapezoidal shim in order to provide the railroad industry with a more uniform article of manufacture to use for securing both flat and curved sections of railroad track.

An object of the invention is to overcome deficiencies in the prior art such as noted above; a further object is to improve rail beds; another object is to provide a "floating" or cushioned rail.

Another object of this invention is to provide a feasible rail fastening system for the railroad industry so that a proper rail cant may be obtained easily and economically on both flat and curved sections of track of a rail system.

Another object of this invention is to provide a system for fastening railroad tracks which can be handled by workmen in the field without need to resort to complicated measurements to ascertain the proper slope of a rail.

Yet another object of this invention is to provide a feasible and economic system for fastening tracks in a subway system in order to maintain a uniform slope of both underground and elevated track sections.

It has been found in nearly all cases of securing a rail to allow passage of trains thereover, that four basic entities are necessary: (1) a railroad tie, (2) a railroad base plate, (3) a rail and (4) a fastening means to secure the bottom flange of the rail to the railroad tie. In situations where the track is curved, it has been found necessary to provide a shim intermediate the base plate and the rail road tie. It is of paramount importance that the bottom flange of the rail be held in a secure fashion to avoid the "backing out" of the fastening means which not only loosens the track but will allow water to penetrate to the railroad tie and cause premature rotting of the same. The instant invention provides such a means for a straight and curved rail system.

The invention herein constitutes an improvement over the embodiments disclosed in my parent copending application Ser. No. 127,995 in several important respects. The washers used in my improved constructions include a stepped thicker portion. Moreover, the bottom surface of the washer used on the side outside the vertical midportion of the rail almost contacts the top surface of the lower flange of the rail so that there is a small gap no larger than $\frac{1}{8}$ inch between the bottom washer surface and the top surface of the lower flange outside of the rail. On the other hand, between the bottom surface of the washer used inside the vertical midportion of the rail and the top surface of the lower flange of the rail, a gap of at least approximately $\frac{1}{4}$ inch exists. Finally, the base plate and the shim plate, each, provide and inclination or cant with respect to the vertical plane of about 3° so that, if both are used, the total inclination approximates 6°.

Conventionally, the distance between the outside edges of opposing rails is about $62\frac{1}{2}$ inches which is fully covered by the train wheels in my improved embodiments of rail track assembly. In the prior art rail track assembly constructions, only about $\frac{2}{3}$ (2 inches of the 3 inch rail crown) was contacted by the train wheels.

On a straight track, where no shim is used the inclination of the rail approximates 3°, while on a curved trackway, where a shim is used under the outside rail, the inclination is about 6°.

Since my improved rail track assemblies provide almost total contact (95–100%) between the rail crown surface and the train wheels, the train load is more equally carried by and balanced between the opposing rails. This will cause less strain in the use of the rails and will increase the longevity of my rail track constructions. Moreover, the contacting surfaces of the train wheels will wear more evenly in use, and will be likewise characterized by increased longevity.

BRIEF DESCRIPTION OF THE DRAWING

FIG. 6 shows a top or plan view of my improved washer construction.

FIGS. 7 and 8 show two embodiments of rail assemblies wherein a screw passes through concentric openings, in a washer and a recessed base plate closely confining a rockable rail flange.

FIG. 9 shows, in side view, a preferred embodiment of my rail track assembly including a recessed base plate and a trapezoidal shaped shim plate, particularly used for the outside rail of a curved track.

DETAILED DESCRIPTION OF INVENTION

Figure 1:
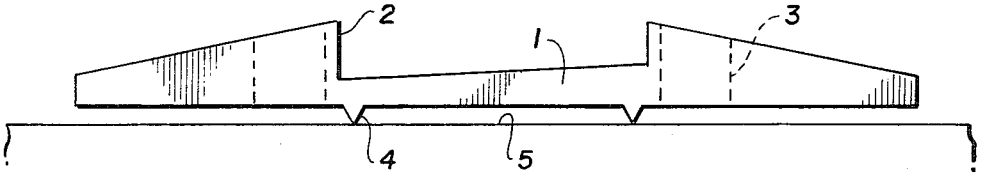
FIG. 1 is a side view of a recessed base plate used in my improved rail track assembly.

FIG. 1 shows a base plate 1 provided with a central rectangular groove 2 in which the base or lower flange of the rail rests, the width of the channel 2 and its height being $\frac{1}{8}$ inch greater than respectively, the width and height of the rail base. Screw holes 3 are provided in the base plate, on each side of the recess slot, accommodating screws which penetrate a wood tie 5.

It should be noted that said holes are elongated and are disposed at a towed-in-angle and the heads of the screws are spaced from the top surface of the base plate by means of an interposed washer 10 shown in FIG. 7.

The bottom surface of the base plate is provided with serrated edges 4 to engage the top surface of the wooden railroad tie 5 to prevent movement of the base plate when the wheels of heavy freight or passenger train cars move over the top flange of rails which are received in the channelled recess of the base plate.

Figure 2:
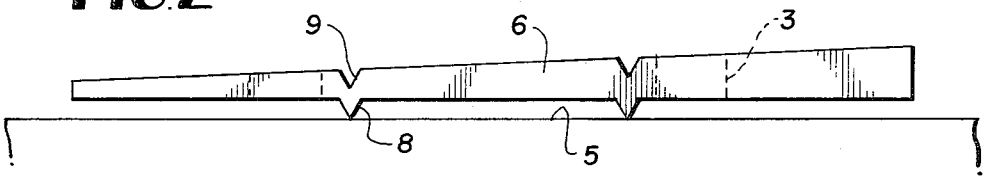
FIG. 2 is a side view of one embodiment of a trapezoidal shim plate used particularly for curved outside or high rails in my rail track assembly.

FIG. 2 shows a trapezoidal shim plate 6 provided with screw holes 7 and serrated edges 8 to engage the top surface of a wooden railroad tie to prevent movement of the shim when heavy trains are moving over the top flange of rails as explained above. The top surface of the shim is provided with grooves 9 which receive the serrated projected edges 4 of the base plate for locking engagement therewith. The thin end of shim plate 6 is approximately $\frac{1}{8}$ inch in thickness while the thicker end measures about $\frac{7}{8}$ inch. The groove in the shim plate is $\frac{1}{4}$ inch deep and mates with the serrations projecting from the bottom of the tie plate about 3/16 inch outwardly from the tie plate surface. This results in a smooth cushioned contact between the serrations in the tie plate and the corresponding grooves in the shim since a gap of ⅛ inch between the tie plate serrations and the shim plate grooves is tolerable. The slope of the shim plate from the two holed end to the one hole end is therefore about 3°. The shim plate is used in combination with the recessed base plate particularly for curved rails and provides an additional inclination of 3°.

Figure 3:
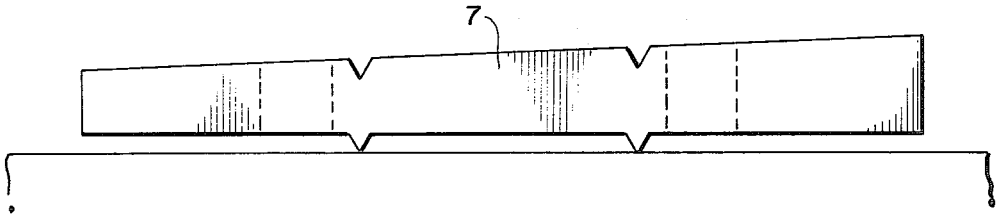
FIGS. 3 to 5 each constitute other embodiments of trapezoidal shim plates, of varying height or lift, also used particularly for curved outside rails in my rail track assembly.
Figure 4:
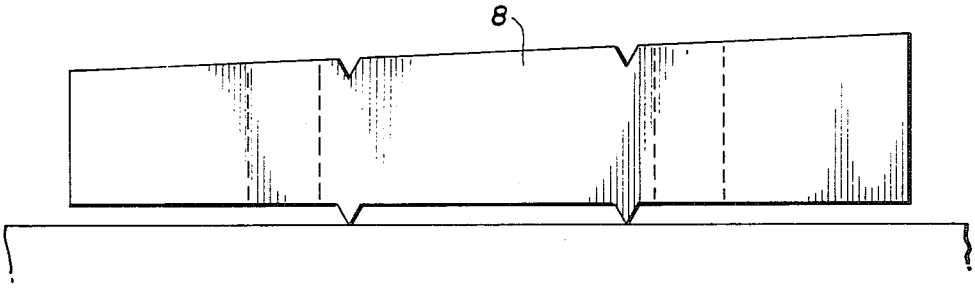
Figure 5:
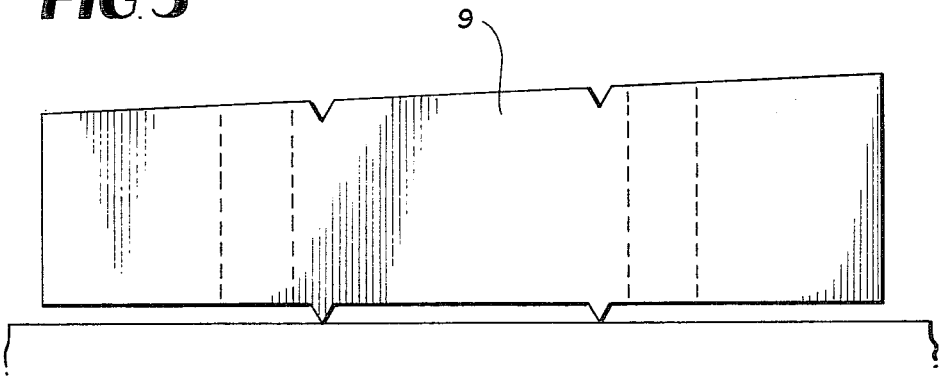

FIGS. 3, 4 and 5 show similar shim plates 7, 8 and 9, which vary in height or lift. Shim 7 provides a one inch lift, shim 8 provides a two inch lift while shim 9 provides a three inch lift. Only one of the various shim plates 6–9 is used in combination with a recessed base plate for the longer outside or high rail of a curved track to provide a desired degree of lift for the trackway.

FIG. 6 shows the improved washer 10 of this invention provided with a screw accommodating opening 12 and showing, in cross section, the stepped thicker portion of the washer.

FIG. 7 shows a recessed base plate receiving the bottom flange 14 of a rail 15. A screw 13 passes through the concentric openings in a washer 10 and in a base plate 1 to rockably confine the rail flange within the recessed channel of the base plate. In this figure the thicker stepped portions of the washer closely approaches the top surface of the flange 14.

FIG. 8 shows an assembly similar to that shown in FIG. 7 except that the thinner portion of the stepped washer closely approaches the top surface of the lower flange 14. It should be noted that rail flanges are not made of uniform shape and vary in the slope or angle of inclination of the top surface thereof with respect to a horizontal plane. The heavy or thicker portion of the washer, due to the force of gravity, will automatically properly seat itself with respect to the sloping top surface of the lower flange 14 when the bottom portion of a train wheel contacts the top surface or crown of the upper flange of the rail 15 shown in FIGS. 11 and 12. Stepped washers 10 are disposed above the shoulder of the lower flange 14 of rail 15 to tightly hold base plate 1 in position and to prevent the rail from leaving channel 2 of the base plate.

The lowermost disposed member of the present rail securing system, namely the tie 5, may be a conventional railroad tie of 6 inch height and 8 inch width which is usually made of wood treated with organic chemicals, such as a heavy mineral oil or creosote, to prevent its rotting in place.

It is understood that conventionally cross-ties measure 9 inches across the top surface. However, where an 8 inch cross-tie is used, the width of the tie plate would correspondingly be one inch less than normal size. It is desirable to maintain about 3° cant or slope and 1° cushion of the rail when it is part of a straight track, i.e. a track disposed on flat land, to provide a 95% match between the crown of the rail and the bottom engaging portion of a train wheel (3° cushion for a curved track). It is for this reason that the rail, when held in place without the use of a shim, should be slightly canted or angled. In order to provide this particular cant, the base plate is provided with its channel 2 for reception of the lower flange 14 of the rail, so that the distance of the rail to the top surface of the tie 5, once the rail is secured within the channel or recess, is greater on the outside of the rail flange than on the inside of the rail. For example, the distance in a perpendicular line from the bottom of the outside rail flange 14 adjacent the corner of the channel to the top surface of the tie, will measure approximately 3/16ths of an inch greater than the distance measured between the bottom of the inside rail flange, adjacent the opposite corner of the channel, and the top surface of the tie. This will secure the rail over relatively flat land to provide the proper cant of the rail crowns which engage the conical treads of the steel railroad train wheels.

The trapezoidal shim plate is provided with one screw hole on the outside portion which is cooperatively secured beneath the outside or higher side of the base plate in contrast with the two screw holes disposed on the inside portion of same for the lower section of the base plate, the width of which roughly equals that of the tie. The bottom surface of the shim plate is provided with serrated grooves for receiving the serrated projecting portions present on the bottom surface of the base plate, which is similarly provided with one screw hole on its outside portion and two screws holes on the inside lower portion of said base plate. When a shim plate is used in the rail track assembly, the inside and outside screw holes are concentrically aligned with the corresponding inside and outside holes in the base plate for reception of the appropriate screws which penetrate into the top surface of the wooden ties, to which the assembly is secured. The holes in the shims are preferably about 1¼ inches in diameter and in the base plate, they are preferably ⅞ inch in diameter, for a ¾ inch diameter screw, or 1 inch in diameter for a ⅞ inch diameter screw.

A complete rail track assembly composed of some of the elements shown in the previous figures, but which does not include a shim plate, such as shown in FIGS. 2–5 and 9, is used on straight trackways. This particular assembly is used to provide the usual rail cant of 3°, mentioned above, for straight track systems disposed on substantially flat land surfaces. Large headed securing screws 16 are driven into position through the appropriate concentric openings in the stepped washers and the base plate and into the tie 5. On both sides of the rail, these screws are angulated at the upper surface of the base plate, at a towed-in-angle, so that if those oppositely disposed screws were longer than they are, they would meet along a line in the ground therebeneath. Stated otherwise these fastening screws are toed-in towards the center of gravity of the rail. The stepped washers 10 are used in order that the bottom of the washer will hold the top shoulder of the lower rail flange in the groove or channel 2 of the base plate. When the rail flange 14 contacts the washer surface and expansion, due to the weather where ambient temperatures may vary from sub 0° to 130° F., occurs, the washer will freely turn while the fastening screw remains firmly fixed. The screws contemplated for this system will normally be ¾ inch in diameter and 5⅞ inches in length, the screw head being hexogonal and 1½ inches in width and ⅜ of an inch thick. The washers used are preferably 2¾ inches in diameter, ¼ inch thick and have a one inch diameter hole to receive the threaded body of the screw. The screw holes in the base plate are preferably ⅞ inch in diameter. After assembly, the bottom surface of the washer will engage the top shoulder of the lower rail flange.

The channel 2 has a width which is desirably ⅛ inch greater than the width of the base of the rail 15. Also, the channel has a height which is suitably ⅛ inch greater than the height of the base, at its corners so that about ⅛ to ¼ inch gap normally exists between the bottom of the washer and the top of the flange 14. These gaps give the rail room to move slightly as the train wheels, which are spaced 8–60 feet apart, pass thereover. As each wheel passes from a unit assembly of the instant rail track system, the rail springs back to its original position. The overall effect is to provide a cushioned or "floating" rail which reduces wear and provides an automatic canter. It is noted in FIG. 11, that in a straight track assembly, the vertical portion of the rail in operation, inclines about 3° with respect to the vertical plane. These above described gaps also provide room to permit rail expansion during hot weather. Also, a $\frac{1}{8}$ to $\frac{1}{4}$ inch gap may be left between the bottom of the screw head and the top surface of the washer when screwing the fasteners into the wooden tie.

As previously stated, in the manufacture of the base plate, holes 3 are provided for passage of the fastening screws therethrough to engage the wooden railroad tie, as shown in FIGS. 11 and 12. It is also desirable that the bottom surface of the rail base plate and of the shims (particularly in the FIG. 12 embodiment) contain projecting serrated edges 4 and 8 respectively, to engage the top surface of the railroad tie to prevent movement of these members as the heavy freight or passenger train cars move over the top flange of the secured rail 15.

FIG. 9 shows a preferred embodiment of my rail track assembly which is particularly suitable for tracks disposed on a sloping or curved land or ground surface. In this embodiment, a trapezoidal shim plate 6–9, having one of the constructions shown in FIGS. 2–5 and 9, is placed in direct contact with the wooden tie. The top surface of the shim is provided with serrated grooves which receive the projecting serrated edges of the recessed base plate 1. Such assemblies are used in the case of tracks disposed in a configuration characterized by sharp curves. In this case, the angulation or cant of the shim is added to that of the base plate and results in an additional 3° vertical inclination of the rail 15; thus the total vertical slope or cant of the rail in this particular embodiment is approximately 6° as shown in FIG. 12. When the rail is in operative engagement with the tread portion of a train wheel, the rail 15 will incline to the position shown in dotted lines in FIG. 12. In situations where tracks are disposed on a slope or curve, centrifugal force changes the angulation of the train wheels relative to the crown of the rail. When this occurs, it is important to raise the cant of the rail so that the crown of the rail will more accurately engage the conical tread of the train car's steel wheels. When such is desired, i.e. on curved trackways, shims of trapezoidal configuration, such as shown in FIGS. 2–5, are placed between the base plate and the railroad tie with the higher edge of the shim located at a point beneath the outside corner of the base plate. The smaller dimension of the trapezoidal shim will be directly underneath the inside corner of the base plate. Thus, using insertable shims of varying size (1/16", $\frac{1}{8}$", 1", 2", or 3" lift) with a single sized base plate provides a railroad with the ability to maintain relatively constant surface contact between the trail wheel tread portion and the crown of the rail even around curves, i.e. the additional angulation provided by the shim compensates for the inevitable shift of the train wheels when the train traverses the curve so as to restore the desired horizontal cant of 3°. The trapezoidal shim possess the same two aligned holes for the screw securing means on the inside portion of the rails and the one hole on the outside portion of the rails, all of which will be congruent and concentrically align with the corresponding holes of the standard sized base plate. The thicker heavy portion of the washer will automatically seat, by gravity, on the low side of the tie plate 15 both for the inside and outside flanges of the rails.

The shim shown in FIG. 2 is to be used on curved tracks under the outside rails, sometimes called the high rail; it is the long rail that is on the outside circle or curve of the track assembly. Using such track construction, about a 3 inch tread width of each wheel is in rolling contact with about a 3 inch portion of the crown of each rail. Thus each cushioned rail is carrying about the same train weight and maintains the rail webs in improved vertical alignment. This results in longer life for the rails and provides a stronger, more safe supporting structure for the moving train. It is important to note that the washers disclosed herein are not used at rail joints; only the penetraing screws are used in this case.

It should be further noted that the purpose of the 3° cant for the trackway is to improve surface contact between the crown of the rail and the head of the train wheel. At 3° cant the weight of the train is more evently spread over the crown of the rail and provides surface contact with about 95% of the crown surface. As a result the wheels and track wear more evenly and the train is better balanced.

Shelling of the rails and cupping of the wheels are reduced thus resulting in reduced train wheel breakage and fewer train wrecks.

By means of the use of the present base plate, trapezoidal shims, fastening screws and stepped washers, the railroad industry is able to economically provide itself with a fast track which is safer, longer lasting, and will require considerably less maintenance over the life of the track. Conversely, older tracks may be more conveniently repaired utilizing the combination of this article of manufacture without the necessity to replace the solid ties lying beneath and perpendicular to the existing rails.

Besides the advantages noted above, the shim and base plate with the $\frac{1}{8}$" clearance between the rail base and the walls of the groove 2, together with a second clearance between the rail base and the washer 10, provide a cushion for the rails which, in turn, improves safety and speed. The common 8" wide tie is retained and the rail is held to it using only three screws. On a straight track, the side friction is minimized as the wheels push the track outwardly, the springing of the rail outwardly about $\frac{1}{8}$" in the channel 2 serving to simultaneously cushion the ride and automatically correct the canter. On curves, the weight of the train is better distributed over the crown of the rail.

It will be obvious to those skilled in the art that various changes may be made without departing from the scope of the invention and the invention is not to be considered limited to what is shown in the drawings and described in the specification. For example, the system may be used for electrified rail systems in conjunction with a layer of insulating material placed beneath the plate or the shim.

What is claimed is:

1. An article of manufacture for securing a train rail to a series of wooden ties, forming a railroad trackway system, wherein the rail has an upper flange for the passage thereover of train wheels and a lower flange for securing of the rail to the railroad ties, comprising:

a plurality of rail supporting base plates, each said base plate being disposed over a railroad tie and each having a width approximately the width of the railroad tie upon which it is disposed, each said base plate having a bottom wall, at least one upper wall, and a sloped rectangular groove disposed in the upper wall and defined by a pair of groove sides and a groove bottom, said sloped rectangular groove extending the width of said base plate and having a width, which exceeds by approximately ¼ inch the width of the lower flange of the rail, so that the rail rests in said sloped groove upon said base plate with gaps of approximately ⅛ inch between the sides of the lower rail flange and the sides of the rectangular groove, the sloped rectangular groove having a depth which exceeds the height of the lower flange of the rail adjacent the sides of the groove;

each said rail supporting base plate being thicker beneath one side of the rectangular groove than beneath the other side of the rectangular groove to provide the slope of said groove, said base plates being placed on the railroad ties such that the outside of each base plate is higher than the inside thereof;

said base plates each having one hole passing therethrough along the outside thereof and two holes passing therethrough along the inside thereof, said holes being adapted to receive therethrough securing screws for holding the base plates to the wooden railroad ties, and said base plates also having means projecting from the bottom walls thereof to prevent movement of the base plates relative to the railroad ties a plurality of trapezoidally shaped shim plates, at least one said trapezoidally shaped shim plate being located immediately beneath a base plate over a railroad tie in a location where the rail is curved, each said trapezoidally shaped shim plate having three holes therein aligned with the three holes of the overlying base plate, the highest elevation of each shim plate being beneath the outside of the overlying base plate with the smaller elevation being beneath the inside of said base plate;

securing screws passing through the holes in said base plates and said trapezoidally shaped shim plates and for engaging with the underlying railroad ties, said screws being elongated and being disposed at a towed-in angle with the heads of said screws being spaced from said base plate; and means to permit the rail to move slightly both horizontally and vertically when a train passes thereover comprising a stepped washer having a thickened portion at one side thereof disposed between the head of each such screw and said base plate to extend over the top of the bottom flange of the rail thereby leaving a gap between the bottom of said washer and the top of the lower flange of the rail, said means permitting the rail to move in a limited confined manner also comprising said gaps of approximately ⅛ inch between the sides of said groove and the sides of the lower rail flange.

2. An article in accordance with claim 1, where upon rolling contact of the tread portion of a train wheel with the upper crown portion of the rail, the rail tilts to form an angle of about 6° with the vertical plane.

3. An article in accordance with claim 1, wherein said base plates also have serrated means projecting from the bottom walls thereof and said trapezoidal shims have serrated grooves to matingly engage with the serrated projections of said base plates, and further said shims also have serrated means projecting from the bottom walls thereof, the foregoing structures cooperating to prevent movement of the base plates and said trapezoidal shims relative to the said railroad ties.

4. An article of manufacture for securing a train rail to a series of wooden ties, forming a railroad trackway system, wherein the rail has an upper flange for the passage thereover of train wheels and a lower flange for securing of the rail to the railroad ties, comprising:

a plurality of rail supporting base plates, each said base plate being disposed over a railroad tie and each having a width approximately the width of the railroad tie upon which it is disposed, each said base plate having a bottom wall, at least one upper wall, and a sloped rectangular groove disposed in the upper wall and defined by a pair of groove sides and a groove bottom, said sloped rectangular groove extending the width of said base plate and having a width which exceeds by approximately ¼ inch the width of the lower flange of the rail so that the rail rests in said sloped groove upon said base plate with gaps of approximately ⅛ inch between the sides of the lower rail flange and the sides of the rectangular groove, the sloped rectangular groove having a depth which exceeds the height of the lower flange of the rail adjacent the sides of the groove;

each said rail supporting base plate being thicker beneath one side of the rectangular groove than beneath the other side of the rectangular groove to provide the slope of said groove, said base plates being placed on the railroad ties such that the outside of each base plate is higher than the inside thereof;

said base plates each having one hole passing therethrough along the outside thereof and two holes passing therethrough along the inside thereof, said holes being adapted to receive therethrough securing screws for holding the base plates to the wooden railroad ties, and said base plates also having means projecting from the bottom walls thereof to prevent movement of the base plates relative to the railroad ties;

securing screws passing through the holes in said base plates for engaging with the underlying railroad ties, said screws being elongated and being disposed at a towed-in angle with the heads of said screws being spaced from said base plate; and means to permit the rail to move slightly both horizontally and vertically when a train passes thereover comprising a stepped washer having a thickened portion at one end thereof, said stepped washer being disposed between the head of each such screw and said base plate to extend over the top of the bottom flange of the rail thereby leaving a gap between the bottom of said washer and the top of the lower flange of the rail, said stepped washer being freely movable between said screw head and said base plate, whereby said washer will turn while said screw remains firmly fixed during longitudinal movement of said rail, said means to permit the rail to move in a limited confined manner also comprising said gaps of approximately ⅛ inch between the sides of said groove and the sides of the lower rail flange.

5. An article in accordance with claim 4, where upon rolling contact of the tread portion of a train wheel with the upper crown portion of the rail, the rail tilts to form an angle of about 3° with the vertical plane.

6. An article in accordance with claim 4, wherein said base plates also have means projecting from the bottom walls thereof to prevent movement of the base plates relative to the railroad ties.

* * * * *